US010612171B2

(12) United States Patent
Reinisch et al.

(10) Patent No.: US 10,612,171 B2
(45) Date of Patent: Apr. 7, 2020

(54) BOBBIN CARRIER FOR A BRAIDING, WINDING OR SPIRALING MACHINE

(71) Applicant: MASCHINENFABRIK NIEHOFF GMBH & CO. KG, Schwabach (DE)

(72) Inventors: Hubert Reinisch, Freiberg am Neckar (DE); Bernd Muller, Schwabach (DE); Bernhard Nagele, Marktoberdorf-Leuterschach (DE)

(73) Assignee: MASCHINENFABRIK NIEHOFF GMBH & CO. KG, Schwabach (DE)

( * ) Notice: Subject to any disclaimer, the term of this patent is extended or adjusted under 35 U.S.C. 154(b) by 443 days.

(21) Appl. No.: 15/512,887

(22) PCT Filed: Sep. 10, 2015

(86) PCT No.: PCT/EP2015/070748
§ 371 (c)(1),
(2) Date: Mar. 21, 2017

(87) PCT Pub. No.: WO2016/045987
PCT Pub. Date: Mar. 31, 2016

(65) Prior Publication Data

US 2017/0298546 A1 Oct. 19, 2017

(30) Foreign Application Priority Data

Sep. 22, 2014 (DE) ..... 10 2014 014 149

(51) Int. Cl.
*B65H 59/38* (2006.01)
*D04C 3/14* (2006.01)
(Continued)

(52) U.S. Cl.
CPC ..... *D04C 3/14* (2013.01); *B65H 59/38* (2013.01); *B65H 63/02* (2013.01); *D04C 3/38* (2013.01); *D04C 3/48* (2013.01); *B65H 2701/36* (2013.01)

(58) Field of Classification Search
CPC ..... B65H 59/38; B65H 59/40; B65H 63/02; D04C 3/14
See application file for complete search history.

(56) References Cited

U.S. PATENT DOCUMENTS 1,989,656 A 1/1935 Staub
3,233,397 A 2/1966 Zbigniew
(Continued)

FOREIGN PATENT DOCUMENTS

CN 1102816 5/1995
CN 1178510 4/1998
(Continued)

OTHER PUBLICATIONS

Official Action with English Translation for Japan Patent Application No. 2017-515729, dated May 20, 2019, 11 pages.
(Continued)

*Primary Examiner* — Tajash D Patel
(74) *Attorney, Agent, or Firm* — Sheridan Ross P.C.

(57) ABSTRACT

The invention relates to a bobbin carrier for receiving a bobbin which is set up for unwinding a strand material, wherein the bobbin carrier is provided for use in a braiding, winding or spiraling machine and is set up to rotate relative to the machine during operation of the latter. The bobbin carrier has a tensile-force measuring device for measuring the tensile force of the strand material unwound from the bobbin and has a first data transfer device for transferring data. According to the invention, the first data transfer device is set up to transfer measured tensile force values to
(Continued)

Figure 1:
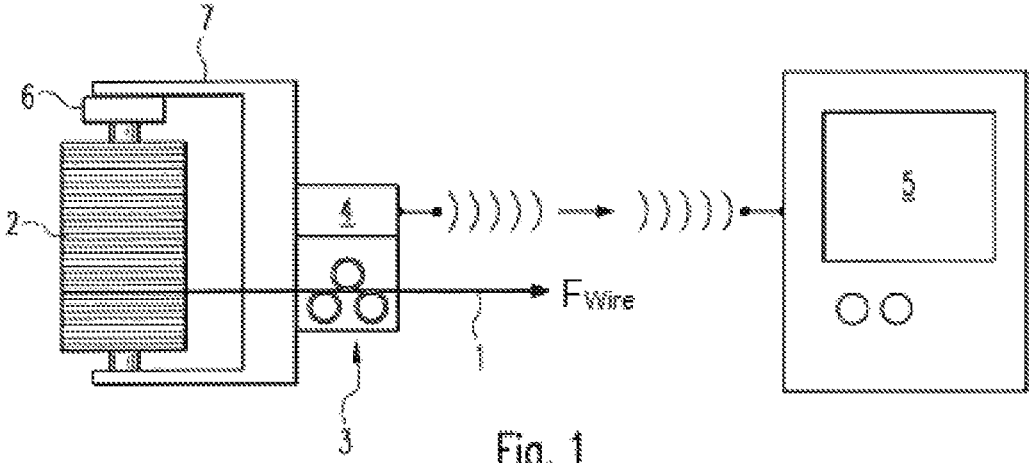

a second data transfer device arranged outside the bobbin carrier. As a result, too low or too high tensile forces in the strand material can be detected early at the individual bobbin carriers. The tensile force can be kept largely constant by the transfer of set point tensile force values from the second data transfer device to the first data transfer device and by a suitable control or regulation device at the bobbin carrier.

14 Claims, 1 Drawing Sheet

(51) Int. Cl.

| | |
|---|---|
| ***B65H 63/02*** | (2006.01) |
| ***D04C 3/48*** | (2006.01) |
| ***D04C 3/38*** | (2006.01) |

(56) References Cited

U.S. PATENT DOCUMENTS

| | | | | |
|---|---|---|---|---|
| 4,059,239 | A * | 11/1977 | Hori | B65H 54/52 242/477.4 |
| 6,851,593 | B2 * | 2/2005 | Weber | A61F 13/15772 226/108 |
| 7,891,597 | B1 | 2/2011 | Henson | |
| 2005/0173579 | A1 * | 8/2005 | Barea | D04B 15/50 242/365.7 |
| 2007/0138331 | A1 * | 6/2007 | Bett | B65H 59/04 242/418.1 |

FOREIGN PATENT DOCUMENTS

| | | |
|---|---|---|
| CN | 104024135 | 9/2014 |
| EP | 1492911 | 9/2010 |
| EP | 2641725 | 9/2013 |
| JP | 2009-293164 | 12/2009 |
| WO | WO 2012/066851 | 5/2014 |
| WO | WO 2014/143917 A1 | 9/2014 |

OTHER PUBLICATIONS

Official Action with English Translation for China Patent Application No. 201580037529.3, dated Jul. 26, 2018, 10 pages.
Search Report for Russia Patent Application No. 2017107432, dated May 16, 2018, 2 pages.
International Search Report prepared by the European Patent Office dated Nov. 10, 2015, for International Application No. PCT/EP2015/070748.
Official Action with English Translation for Brazil Patent Application No. BR112017003811-0, dated Nov. 25, 2019, 5 pages.

* cited by examiner

BOBBIN CARRIER FOR A BRAIDING, WINDING OR SPIRALING MACHINE

CROSS REFERENCE TO RELATED APPLICATIONS

This application is a national stage application under 35 U.S.C. 371 and claims the benefit of PCT Application No PCT/EP2015/070748 having an international filing date of 10 Sep. 2015, which designated the United States, which PCT application claimed the benefit of German Patent Application No DE 10 2014 014 149 7 filed 22 Sep. 2014, the disclosures of each of which are incorporated herein by reference in their entireties.

The invention relates to a bobbin carrier for accommodating a bobbin designed for unwinding a strand stock, wherein the bobbin carrier is provided for use in a braiding, winding or spiraling machine. Strand stock is hereby to be understood as an elongated, stranded material, particularly, but not exclusively, wire which can contain iron, preferentially however containing non-ferrous metals, or textile fibers, carbon fibers or other stranded carbon materials.

The invention further relates to a tensile force measuring system for measuring the tensile force of the strand stock unwound from the bobbin, a braiding, winding or spiraling machine having such a tensile force measuring system, a corresponding method for measuring tensile force as well as a visualization system for a braiding, winding or spiraling machine.

Braiding machines, in particular rotary braiding machines, are used in the manufacture of hollow braided tubes from the strand stock to be processed, particularly from metal wires, twine or plastic fibers, or of flat stranded meshwork (by subsequently rolling such braided tubes), of plaited mesh or also for braiding for example a wire-meshed cable or in the manufacture of low-mass bodies, particularly in light construction, by braiding carbon fibers or other stranded carbon materials. Areas of application for technical meshwork manufactured as such include for example sheaths for electrical cables to shield against electromagnetic fields or protective enclosures to protect cables or tubes from mechanical stress. A further application is the manufacture of medical meshing for vascular implants, for example stents or vascular prostheses.

During the operation of the braiding machine, multiple strands of the strand stock to be braided are wound at a specific angle in opposite directions around a braid axis or around the strand stock to be braided, e.g. a cable, thereby crossing each other according to a specific pattern and thus yielding the desired mesh.

Winding machines are similar to braiding machines in terms of function with the difference that the strands of the strand stock to be processed are not interwoven but rather rest loosely on one another or on the strand stock to be wrapped. Winding machines can deposit one or also multiple layers of windings on the strand stock to be processed. Winding machines are used for example in the manufacture of cords or ropes, sheathing for hoses or cables or reinforcements for pressure hoses.

Spiraling machines largely correspond to winding machines in terms of function, whereby the strand stock to be braided is preferably plastically deformable and therefore forms a self-supporting coil when being wound around the braid axis or around the strand stock to be braided respectively. Spiraling machines are used for example to sheath copper wire cables or cables with coiled steel wires.

Common to all the machines considered is that they have a plurality of bobbin carriers on which at least one bobbin each is arranged on which a strand of the strand stock to be processed is wound and is then unwound from this strand and processed during the machine's operation. The bobbin carrier is thereby configured to rotate relative to the machine during its operation. The unwound strand stock is thereby guided around the braid axis, or around the strand stock to be braided respectively, which is concurrently moving in its longitudinal direction.

The invention will be described in the following using the example of a braiding machine for wire as the strand stock to be braided; i.e. for the manufacture of wire mesh. However, this does not constitute any limitation; the invention can also be used for other braiding, winding or spiraling machines for processing any given strand stock.

During operation of a braiding machine, the tensile force; i.e. the mechanical tension of the wires unwound from the bobbins, plays an important role: When the tensile force is too low, the braid pattern of the produced meshwork can be uneven, the wires can "tangle up" within the machine or even break. When the tensile force is too high, the wires can likewise break, particularly at high process speeds. Both result in higher rejects and/or longer machine downtimes and thus increase the production costs.

Mechanical solutions are generally employed in the prior art for setting and regulating the wire tensile force, particularly a mechanical band brake or shoe brake for the bobbin mounted on the bobbin carrier coupled with a mechanical control or regulating system for governing the braking torque applied by the brake on the bobbin as a function of the bobbin winding diameter and/or the wire tensile force.

U.S. Pat. No. 7,270,043 B2, on the other hand, proposes electrically powering the mechanical deflecting of the wire paying off the lower, radially outer bobbins of a rotary braiding machine at variable speeds in order to guide it over or under the upper, radially inner bobbins. The target wire payoff speed is thereby communicated to the bobbin carrier via a slip ring or also wirelessly and the wire payoff speed regulated at the bobbins so as to correspond to the braiding production speed. Impulsive spikes in the wire tension caused by the wire deflection and wire feed process should thereby be prevented.

Technical problems with such control or regulating devices, such as for example the misadjustment of a bobbin carrier or brake wear, can however only be indirectly recognized by the machine operator when one of the above-cited signs of too low or too high tensile force such as an uneven braid pattern appears or a wire breaks.

The present invention is thus based on the task of improving the control and/or regulation of the tensile force of the strand stock unwound from the bobbins of a braiding, winding or spiraling machine and thereby in particular enables identifying of a tensile force which is too low or too high at an early stage.

This task is solved by a bobbin carrier according to claim 1, a tensile force measuring system according to claim 9, a braiding, winding or spiraling machine according to claim 11, a method for measuring tensile force according to claim 12, as well as a visualization system according to claim 13. Further advantageous developments of the invention are set forth in the subclaims.

The invention is based on a bobbin carrier for accommodating a bobbin designed for unwinding a strand stock, whereby the bobbin carrier is intended for use in a braiding, winding or spiraling machine and to that end also designed to rotate relative to the machine during its operation. As noted above, the invention will be described in the following using the example of a wire braiding machine.

The bobbin carrier comprises a tensile force measuring device for measuring the tensile force of the wire unwinding; i.e. paying off from the bobbin. The tensile force measuring device is preferably based on mechanical, optical, electromagnetic or other physical principles. In the case of a mechanical tensile force measuring device, preferably the deflection of a measuring bracket pressed against the passing wire is measured. With an optical tensile force measuring device, preferably the line specified by the passing wire is detected by optical sensors, particularly by a camera, and its form or oscillations preferably evaluated. Such tensile force measuring devices are known in the prior art and will thus not be described in greater detail at this point.

Furthermore, the bobbin carrier comprises a first data transmission device for transmitting, in particular sending and/or receiving, data. The first data transmission device is preferably an electronic, further preferably a digital data transmission device. Preferably, the first data transmission device supports at least one of the common wired or wireless technical standards, respectively standard protocols, for data transmission, preferably Ethernet, IP, CAN bus, WLAN, Bluetooth, Zigbee or ANT.

According to the invention, the first data transmission device is designed to transmit measured tensile force measurement values to a second data transmission device disposed external of the bobbin carrier. The second data transmission device is preferably fixedly disposed relative to the machine but can, however, also move relative to the machine or be arranged spatially independent of the machine, preferably as a portable device for the machine operator.

Preferably, the tensile force measurement values are transmitted together with an identification of the respective bobbin carrier, particularly a number or identification code. By so doing, the tensile force values measured at the individual bobbin carriers can be communicated by the second data transmission device to the machine operator by way of a suitable display apparatus and/or stored and/or further applicably processed, preferably for process documentation, preferably in real time and/or together with the identification of the respective bobbin carrier.

The display unit is also preferably fixedly disposed relative to the machine, however can also move relative to the machine or be arranged spatially independent of the machine, preferably as a portable unit for the machine operator. The second data transmission device and the display unit are preferably both integrated into one device, preferably the machine control system or a portable device, preferably a tablet or a notebook computer. The portable device can, however, also incorporate only the display unit to which the data from the second data transmission device is to be transmitted by data forwarding.

The operator can thereby promptly recognize tensile force values which are too low or too high and directly attribute them to individual bobbin carriers to improve failure analysis. The manufacturing quality is thus made independent of the operator's "expert knowledge." Furthermore, a separate wire breakage monitoring device as used in prior art braiding machines is also rendered redundant, since a measured tensile force measurement value of zero already indicates a broken wire, upon which the machine preferably automatically switches off.

In a further preferential implementation of an inventive bobbin carrier, same comprises a control and/or regulating device for controlling or regulating the tensile force of the strand stock unwound from the bobbin. This thus enables not only the monitoring of the tensile force but also being able to precisely adjust and correct it.

In one preferential implementation of an inventive bobbin carrier, the first data transmission device is further designed to receive target tensile force values from the second data transmission device. Doing so allows the control and/or regulating behavior of the control and/or regulating system for the bobbin carrier brake, which in the prior art is characterized by a rigid, in particular mechanical coupling between the tensile force measuring device and the spool carrier brake, to be adapted dynamically to the production requirements, preferably in real time. In particular thereby prevented are the braiding defects and wire breakage which occur at high process speeds.

Data is preferably transmitted from the first to the second data transmission device via a slip ring fixedly disposed relative to the machine on which rotates a sliding contact arranged on the bobbin carrier and rotating with same, forming a part of the first data transmission device.

In a particularly preferential implementation of an inventive bobbin carrier, however, the first data transmission device is configured for wireless data transmission to and/or from the second data transmission device, preferably via electromagnetic waves, particularly radio signals or light signals, or via an inductive coupling. This renders a wired connection between the rotary bobbin carriers and the second data transmission device arranged external of the bobbin carrier redundant. In the case of an inductive coupling, preferably a first inductive transmission element on the first data transmission device on the bobbin carrier and a second inductive transmission element are fixedly mounted to the machine or on a thereby likewise rotating braiding rotor.

In a further particularly preferential implementation of a bobbin carrier according to the invention, the first data transmission device is configured for data transmission to and/or from the second data transmission device via the strand stock unwound from the bobbin. This presupposes that data is transmitted by electrical signals and that the strand stock is electrically conductive. Preferably, this type of data transmission is used when the strand stock is a metallic wire. The electrical signals can then be taken from the braided/interwoven product by the second data transmission device, or fed into same respectively, preferably at a capstan which draws the product off a braiding sleeve onto which the braiding was realized, or from the braiding sleeve itself.

In this implementation of an inventive bobbin carrier, the electrical connection which already exists between the rotary bobbin carriers and the stationary part of the machine in the form of the strand stock to be processed is used to transmit data. This thus enables, on the one hand, using a technically simpler wired data transmission versus a technically more complex wireless data transmission and, on the other, does away with the need for additional electrical connection lines for data transmission.

In a further implementation of an inventive bobbin carrier, the bobbin carrier comprises a power supply device having a generator for generating electrical energy, particularly having a dynamo, an electric motor or a generator rotor configured to supply energy to the bobbin carrier.

In the case of the power supply device comprising a dynamo, it is preferably powered by the rotating bobbin or by wire guide rolls. Further preferably, the dynamo is powered by a drive wheel, particularly a gear wheel or a friction wheel, by a braiding rotor preferably rotating in the opposite direction on which further bobbin carriers are fixed, or by stationary machine components such as a base plate.

In the case of the power supply device having an electric motor, same is preferably arranged in the bobbin carrier and operates in brake mode, whereby the electric motor can then simultaneously serve as an electromagnetic bobbin brake. This thereby yields the further advantage of being able to dispense with the mechanical bobbin brake commonly used in the prior art.

In the case of the power supply device having a generator rotor, permanent magnets are preferably arranged in an opposite braiding rotor preferably rotating in the opposite direction, same inducing a voltage in the rotor preferably comprising a wire loop.

In a further preferential implementation of a bobbin carrier according to the invention, same comprises an energy transmission device for receiving and/or converting electrical energy, particularly an electrical contact device or an inductive coupler configured to supply energy to the bobbin carrier.

Analogous to the above-cited implementations for the data transmission, in the case of an electrical contact device, preferably a rotating sliding contact is arranged on the energy transmission device on the bobbin carrier and a slip ring fixedly arranged on the machine; in the case of an inductive coupler, preferably a first inductive transmission element is arranged on the energy transmission device on the bobbin carrier and a second inductive transmission element fixedly mounted on the machine or to rotate on a braiding rotor.

In a further particularly preferential implementation of an inventive bobbin carrier, the energy transmission device is configured to receive electrical energy via the strand stock unwinding from the bobbin.

Analogous to the above-described data transmission by means of the strand stock unwinding from the bobbin, this presupposes that the strand stock is electrically conductive. The electrical energy can then be fed into the braided/plaited product, preferably into the capstan or the braiding sleeve. The advantages yielded by this implementation are to a large extent also similar to the above-described implementation of data transmission via the strand stock unwound from the bobbin.

The invention further relates to a tensile force measuring system. A tensile force measuring system according to the invention comprises a plurality of bobbin carriers in accordance with at least one of the above described implementations and a second data transmission device arranged external of the bobbin carrier. The tensile force measuring system is configured for the unidirectional or bidirectional transmission of data between the first data transmission device of the bobbin carrier and the second data transmission device. Depending on the implementation of the bobbin carrier, the tensile force measuring system can also be configured to provide further functionalities beyond those described above in conjunction with the bobbin carriers. An existing braiding machine can also be retrofit with an inventive tensile force measuring system; the bobbin carriers hereby essentially need to be replaced and the second data transmission device additionally provided.

In one preferential implementation of the inventive tensile force measuring system, same further comprises a data processing device connected to the second data transmission device and configured to store, evaluate and/or display the data transmitted from the first data transmission device to the second data transmission device. As previously noted above, this thereby enables, among other things, early detection of tensile forces which are too low or too high as well as enables process documentation.

The invention further relates to a braiding, winding or spiraling machine equipped with a tensile force measuring system according to the invention.

The invention further relates to a method for measuring tensile force to be performed on an inventive tensile force measuring system. In the inventive method, the tensile force measuring devices of the bobbin carriers measure tensile force measurement values and the first data transmission devices transmit the tensile force measurement values to the second data transmission device. Depending on how the bobbin carriers are implemented in the tensile force measuring system, the inventive method can further realize the functions described above with respect to the bobbin carriers.

The invention further relates to a visualization system for a braiding, winding or spiraling machine. A visualization system is to hereby be understood as a system with which at least one component of the system can be made optically visible in a specific, preferably time-dependent, manner.

The inventive visualization system comprises a braiding, winding or spiraling machine having a plurality of bobbin carriers each accommodating a respective bobbin for unwinding a strand stock, whereby the bobbin carriers are configured to rotate relative to the machine during its operation. The visualization system further comprises a visualizing device for periodically visualizing at least one bobbin carrier, same being configured to visualize the at least one bobbin carrier during each period for less than a hundredth, preferably less than a thousandth, further preferably less than a ten-thousandth, even further preferably less than a hundred-thousandth of the time needed for one rotation of the bobbin carrier, whereby the length of the period is substantially equal to the length of time for one rotation of the bobbin carrier or is an integral multiple of same.

By synchronizing the time for visualizing the at least one bobbin carrier with the rotation of the bobbin carrier, the operator of the machine can see the at least one bobbin carrier in substantially the same place each time it is visualized. By so doing, the operator can also observe and evaluate the progression of the strand stock being unwound from the bobbin carrier and braided during the braiding process from substantially the same point. In particular, a large bulge or an oscillating of a wire can indicate tensile force which is too low and thus a brake set to insufficient strength on the observed bobbin carrier. Markings on the bobbin carrier, preferably inscribed numbers or the like, enable the observed bobbin carrier to be uniquely identified and located again after the machine is switched off, particularly for the purpose of servicing the bobbin carrier.

In one preferential implementation of the inventive visualization system, the visualizing device is a stroboscope, shutter glasses or a light source/chopper combination. A stroboscope is hereby to be understood in the usual way as a source of light which repetitively emits brief flashes of light. Shutter glasses are understood as being glasses able to repetitively enable or block the light permeability of the glass lenses to both eyes separately or together, preferably by an appropriate arrangement of polarizing filters in the glass lenses. A chopper is to be understood as a preferably rotating aperture able to be disposed in front of a light source in order to repetitively allow and block its light from passing through.

The cited visualizing devices are standard products, which thereby enables the visualization system to be realized inexpensively.

The visualization device is preferably synchronized with the rotational frequency of the bobbin carrier by manually setting the visualization frequency on the visualization device or, should the visualization device provide for such a function, by automatic synchronization, preferably with a machine-produced reference signal which preferably consists of a periodic light signal at the same frequency as the rotational frequency of the bobbin carrier.

Figure 2:
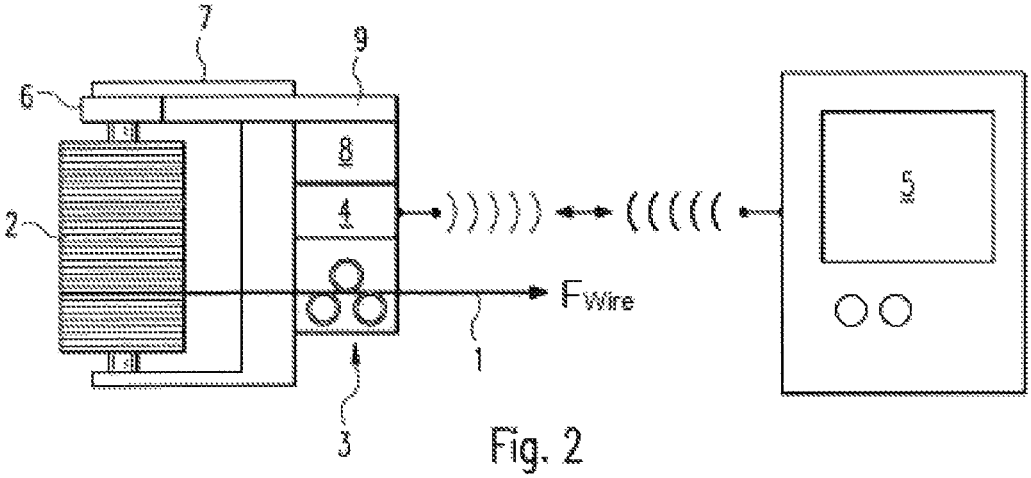

Further advantageous embodiments of the invention are set forth in the accompanying drawings in conjunction with the following description. Shown are:

FIG. 1 a schematic depiction of a tensile force measuring system for a wire braiding machine according to the invention;

FIG. 2 the schematic depiction of FIG. 1 having an additional control or regulating system.

The braiding machine equipped with an inventive mechatronic tensile force measuring system on which the embodiments are based comprises a large number of bobbin carriers, preferably between 8 and 36.

The tensile force measuring system according to FIG. 1 comprises a bobbin carrier 7 having a wire tensile force measuring device 3 which directly or indirectly measures the wire tensile force $F_{Wire}$ of the wire 1 paying off a bobbin 2. A direct measurement is preferably realized by an integrated force measuring sensor. An indirect measurement is preferably realized utilizing the travel path of the dancer. There is a direct correlation here between the travel path of the dancer arm or carriage and the wire tensile force $F_{Wire}$ which serves in calculating the wire tensile force $F_{Wire}$.

The measured value for the wire tensile force $F_{wire}$ is transmitted to a programmable control unit, in the given embodiment to a microcontroller 4, where it is processed and prepared. A first data transmission device 4 is arranged on or integrated in the microcontroller 4 which transmits the prepared measured values to a second data transmission device 5 arranged on or integrated into a display device 5. In the tensile force measuring system according to FIG. 1, data is wirelessly transmitted via radio, preferably at a frequency of 2.4 GHz. Further preferably, the braid wire 1 to be processed can itself also be used as a data transmission medium or an inductive coupler can be used.

The display device/second data transmission device 5 can also be movably disposed, preferably on a rotating turntable and fixed relative to same. In this case, data can additionally be forwarded to components external of the turntable, particularly fixedly arranged relative to the machine, preferably via a slip ring.

Process data can in this way be transmitted between the bobbin carrier 7 and a higher-level entity in the process hierarchy, namely the display device 5, preferably for the documentation and/or visualization of the process data. A (not shown) machine control or an external control device, preferably a laptop or a tablet computer, preferably serves as the visualization, information and input unit for the operator.

The data transmission of the process data is hereby a unidirectional transmission, preferably, however, a bidirectional transmission.

In unidirectional data transmission, actual data, particularly the wire tensile force $F_{Wire}$, is preferably transmitted to the higher-level machine control system and further processed and/or stored there. In addition to the wire tensile force $F_{Wire}$, further actual data preferably includes warning notifications when certain thresholds and set limits are exceeded, preferably wear limits for the brake unit 6, which will be described in greater detail below.

In bidirectional data transmission, additional target data, preferably the target wire tensile force, is preferably transmitted from the machine control system to the bobbin carrier 7 (see the more detailed explanation in conjunction with FIG. 2 below).

All the actual and target data are preferably transmitted together with a distinct bobbin carrier identification which allows the data to be uniquely allocated to a bobbin carrier 7.

The bobbin carrier 7 furthermore comprises a braking unit 6 for the bobbin 2 for generating the required wire tensile force $F_{Wire}$. A mechanical band brake, shoe brake or disk brake is preferably used as the wire/bobbin brake. Further preferably, an electric braking motor or a magnetically operated brake, particularly a magnetic brake, an eddy current brake, a hysteresis brake or a rheological hydraulic brake, can also be used.

Furthermore, the bobbin carrier 7 comprises a (not shown) power supply device for the electrical components of the bobbin carrier 7. Power can thereby be supplied directly via the braid wire 1 by a voltage and current supply source fixedly arranged relative to the machine. In so doing, preferably small amounts of energy, particularly for supplying an (energy-saving) control unit, the wire tensile force measuring device 3 and a preferably small number of actuators is thereby efficiently transmitted. The braiding sleeve thereby preferably forms the positive terminal. The wire guide members on the bobbin carrier 7 are preferably fixed on an isolator. The frame of the bobbin carrier 7 is preferably grounded via a slideway on which the bobbin carrier rotates.

Preferably, an energy transmission device via an inductive coupler, a preferably small current generator operating in parallel, or via sliding contacts is also applicable. With an inductive coupler, electrical energy is transmitted via two wire coils, whereby preferably the fixed coil acts as the energy transmitter and the moving coil as the energy receiver. A current generator or a dynamo is preferably integrated into the bobbin carrier 7 and directly or indirectly powered by the rotating bobbin 2 or by the payoff wire 1. Preferably, magnets can also be integrated into a braiding rotor which simultaneously serve as a rotating guideway carrier. As soon as the bobbin carrier 7, which may be mounted on a carrier carriage where applicable, with the bobbin 2 disposed thereon passes by such a magnet, a voltage is induced in a wire winding disposed on the bobbin carrier 7.

Further preferably, the bobbin carrier 7 can also comprise a preferably small accumulator or buffer capacitor which furnishes the required electrical energy upon machine stop or a changing of the bobbin 2 and serves as an energy buffer.

The tensile force measuring system shown in FIG. 2 expands upon that as shown in FIG. 1 by way of an electronic control and regulating system 8 for the wire tensile force $F_{Wire}$ in which a program for influencing the reaction of the braking unit 6 for controlling and regulating the wire tensile force $F_{Wire}$ in terms of time and intensity is stored. The program can preferably be modified by the first and the second data transmission device 4, 5 engaging directly with the control and regulating system 8 when the machine is idle, further preferably, however, also when the machine is running. To this end, a compact, freely programmable microcontroller 4 is provided so as to be able to flexibly adapt the control and regulation algorithm to the product and process requirements. The microcontroller 4 is supplied with electrical energy via the power supply device described above.

Preferably—and additionally to the above-described wire tensile force measured values—a target wire tensile force is transmitted from the machine control system and the second data transmission device 5 to the first data transmission device 4 and the microcontroller 4 via bidirectional data transmission, which is then used as the target value for the control and regulating system 8. The target wire tensile force can thereby preferably be preset by the machine operator.

The control and/or regulation is preferably realized by means of an actuator 9 on the dancer and/or by an actuator 9 on the brake unit 6. Furthermore, the tensile force measuring system according to FIG. 2 further comprises actuators 9 for setting the dancer force and/or setting the braking torque applied by the braking unit 6 on the bobbin 2.

An actuator for setting the dancer force is preferably provided when target data for the wire tensile force is to be transmitted from the higher-level entity, preferably the machine control system, to the bobbin carrier 7. The dancer force at the operating point; i.e. at mid-position, is preferably changed by means of the dancer spring pretensioning.

The braking torque of the braking unit 6 is preferably likewise changed by an actuator 9 based on the target data for the wire tensile force $F_{Wire}$ and adapted to the process requirements. A largely constant wire tensile force $F_{Wire}$ can thus be achieved.

The tensile force measuring system according to the invention yields improved quality to the braid pattern as a result of a more uniform bobbin carrier setting. Furthermore, the machine operator can be given indications for preventive bobbin carrier servicing when individual bobbin carriers 2 exceed specific predefined wire tensile force $F_{Wire}$ thresholds. This allows prompt detection of malfunctions and thus reduces machine downtimes.

The tensile force measuring system according to the invention furthermore enables continuous process data acquisition and storage for the purpose of quality verification, preferably proof of process capability, and/or documentation. Furthermore, operation of the machine is facilitated by the target wire tensile force being able to be automatically set at individual or all bobbin carriers 2 via the display unit 5 in the machine control system.

LIST OF REFERENCE NUMERALS

1 wire
2 bobbin
3 wire tensile force measuring device
4 microcontroller/first data transmission device
5 display unit/second data transmission device
6 braking unit
7 bobbin carrier
8 control and regulation system
9 actuator for setting the wire tensile force

The invention claimed is:

1. A bobbin carrier for accommodating a bobbin designed for unwinding a strand stock, wherein the bobbin carrier is intended for use in a braiding, winding or spiraling machine and to that end designed to rotate relative to the machine during its operation, which comprises a tensile force measuring device for measuring the tensile force of the strand stock unwound from the bobbin and a first data transmission device for transmitting data, wherein the first data transmission device is designed to transmit measured tensile force measurement values to a second data transmission device disposed external of the bobbin carrier.

2. The bobbin carrier according to claim 1, wherein the bobbin carrier comprises a control and/or regulating device for controlling or regulating the tensile force of the strand stock unwound from the bobbin.

3. The bobbin carrier according to claim 2, wherein the first data transmission device is further designed to receive target tensile force values from the second data transmission device.

4. The bobbin carrier according to claim 1, wherein the first data transmission device is configured for wireless data transmission to and/or from the second data transmission device, preferably via radio signals, light signals or an inductive coupling.

5. The bobbin carrier according to claim 1, wherein the first data transmission device is configured for data transmission to and/or from the second data transmission device via the strand stock unwound from the bobbin.

6. The bobbin carrier according to claim 1, wherein the bobbin carrier comprises a power supply device having a generator for generating electrical energy, particularly a dynamo, an electric motor or a generator rotor configured to supply energy to the bobbin carrier.

7. The bobbin carrier according to claim 1, wherein the bobbin carrier comprises an energy transmission device for receiving and/or converting electrical energy, particularly an electrical contact device or an inductive coupler configured to supply energy to the bobbin carrier.

8. The bobbin carrier according to claim 7, wherein the energy transmission device is configured to receive electrical energy via the strand stock unwinding from the bobbin.

9. A tensile force measuring system having a plurality of bobbin carriers according to claim 1 and a second data transmission device arranged external of the bobbin carrier which is configured for the unidirectional or bidirectional transmission of data between the first data transmission device of the bobbin carrier and the second data transmission device.

10. The tensile force measuring system according to claim 9 further comprising a data processing device connected to the second data transmission device and configured to store, evaluate and/or display the data transmitted from the first data transmission device to the second data transmission device.

11. A braiding, winding or spiraling machine having a tensile force measuring system according to claim 9.

12. A method for measuring tensile force to be performed on a tensile force measuring system according to claim 9 in which the tensile force measuring devices of the bobbin carriers measure tensile force measurement values and the first data transmission devices transmit the tensile force measurement values to the second data transmission device.

13. A visualization system for a braiding, winding or spiraling machine comprising a braiding, winding or spiraling machine having a plurality of bobbin carriers for respectively accommodating one bobbin each for unwinding a strand stock, wherein the bobbin carriers are configured to rotate relative to the machine during its operation, and a visualizing device for periodically visualizing at least one bobbin carrier which is configured to visualize the at least one bobbin carrier during each period for less than a hundredth of the time needed for one rotation of the bobbin carrier, wherein the length of the period is substantially equal to the length of time for one rotation of the bobbin carrier or is an integral multiple of same.

14. The visualization system according to claim 13, wherein the visualizing device is a stroboscope, shutter glasses or a combination of light source and chopper.

* * * * *